US009085308B2

(12) United States Patent
Laliberte et al.

(10) Patent No.: US 9,085,308 B2
(45) Date of Patent: Jul. 21, 2015

(54) PASSIVELY ACTUATED BRAKING SYSTEM

(71) Applicants: GM Global Technology Operations LLC, Detroit, MI (US); Universite Laval, Quebec (CA)

(72) Inventors: Thierry Laliberte, Quebec (CA); Clement Gosselin, Quebec (CA); Dalong Gao, Rochester, MI (US); Marc-Antoine Lacasse, Quebec (CA); Roland J. Menassa, Macomb, MI (US)

(73) Assignees: GM Global Technology Operations LLC, Detroit, MI (US); Universite Laval, Quebec, Ontario (CA)

( * ) Notice: Subject to any disclaimer, the term of this patent is extended or adjusted under 35 U.S.C. 154(b) by 0 days.

(21) Appl. No.: 13/664,976

(22) Filed: Oct. 31, 2012

(65) Prior Publication Data

US 2013/0112645 A1 May 9, 2013

Related U.S. Application Data

(60) Provisional application No. 61/555,812, filed on Nov. 4, 2011.

(51) Int. Cl.

| | |
|---|---|
| ***B66C 19/00*** | (2006.01) |
| ***B61H 5/00*** | (2006.01) |
| ***B66C 7/00*** | (2006.01) |
| ***B66C 9/18*** | (2006.01) |

(52) U.S. Cl.

CPC .. *B61H 5/00* (2013.01); *B66C 7/00* (2013.01); *B66C 9/18* (2013.01)

(58) Field of Classification Search

USPC ..... 212/328–329, 336–338, 343–344, 312, 212/320–324; 188/2 D

See application file for complete search history.

(56) References Cited

U.S. PATENT DOCUMENTS

| | | | | | |
|---|---|---|---|---|---|
| 2,212,696 | A | * | 8/1940 | Nash | 105/148 |
| 2,737,596 | A | * | 3/1956 | Haupt et al. | 378/194 |
| 2,848,120 | A | * | 8/1958 | Harmon | 212/337 |
| 3,814,211 | A | * | 6/1974 | Pamer | 182/14 |
| 3,874,514 | A | * | 4/1975 | Wilson | 212/290 |
| 3,883,119 | A | * | 5/1975 | Hansson | 254/344 |
| 4,382,413 | A | * | 5/1983 | Kakehi et al. | 105/163.1 |
| 4,570,543 | A | * | 2/1986 | Ishikura et al. | 104/300 |
| 4,762,239 | A | * | 8/1988 | Wissman et al. | 212/179 |
| 4,858,775 | A | * | 8/1989 | Crouch | 212/312 |
| 4,883,184 | A | | 11/1989 | Albus | |

(Continued)

FOREIGN PATENT DOCUMENTS

JP 2005334999 A 12/2005

*Primary Examiner* — Emmanuel M Marcelo
*Assistant Examiner* — Michael Gallion
(74) *Attorney, Agent, or Firm* — Quinn Law Group, PLLC

(57) ABSTRACT

A movement system includes a rail, a trolley, and a braking system. The trolley is movably attached to the rail and configured to support the payload. The braking system is operatively attached to the rail. The braking system includes a braking module having a base, operatively attached to the trolley, and a wheel assembly, operatively attached to the base. The wheel assembly has a shaft, a clutch, and a braking wheel. The clutch is rigidly attached to the shaft and configured for rotation with the shaft about the rolling axis. The braking wheel axially surrounds the clutch and is in continuous rolling contact with a surface of the rail. The clutch is configured to selectively allow rotation of the braking wheel relative to the shaft in only one direction of rotation to decelerate movement of the trolley along the rail.

17 Claims, 10 Drawing Sheets

(56) References Cited

U.S. PATENT DOCUMENTS

| | | | | |
|---|---|---|---|---|
| 4,892,203 | A * | 1/1990 | Arav | 212/331 |
| 5,107,997 | A * | 4/1992 | Worsley | 212/89 |
| 5,337,908 | A * | 8/1994 | Beck, Jr. | 212/312 |
| 5,603,420 | A | 2/1997 | Swanson | |
| 5,803,278 | A * | 9/1998 | Shiwaku | 212/274 |
| 6,840,393 | B2 * | 1/2005 | Tu | 212/328 |
| 7,597,050 | B2 * | 10/2009 | Waisanen | 105/163.1 |
| 7,762,757 | B2 * | 7/2010 | Ueda et al. | 414/590 |
| 7,775,384 | B2 * | 8/2010 | Zaguroli, Jr. | 212/331 |
| 7,793,794 | B2 * | 9/2010 | Cho | 212/312 |
| 7,883,450 | B2 * | 2/2011 | Hidler | 482/69 |
| 8,191,551 | B2 * | 6/2012 | Skovgard | 128/204.18 |
| 8,296,878 | B2 * | 10/2012 | Imhoff | 5/85.1 |
| 8,550,267 | B2 * | 10/2013 | Lee et al. | 212/319 |
| 2002/0179560 | A1 * | 12/2002 | Plass | 212/312 |
| 2005/0189183 | A1 * | 9/2005 | Gil et al. | 188/2 D |
| 2006/0113150 | A1 * | 6/2006 | Baumgartner et al. | 188/2 D |
| 2007/0012642 | A1 * | 1/2007 | Imao et al. | 212/328 |
| 2010/0145526 | A1 * | 6/2010 | Yamaguchi et al. | 700/275 |
| 2010/0237306 | A1 * | 9/2010 | Eschelbacher et al. | 254/362 |
| 2011/0036799 | A1 * | 2/2011 | Mckay | 212/312 |
| 2012/0000876 | A1 * | 1/2012 | Bergenstrale et al. | 212/336 |
| 2012/0193315 | A1 * | 8/2012 | Noll | 212/312 |
| 2013/0248477 | A1 * | 9/2013 | Gao et al. | 212/312 |

* cited by examiner

PASSIVELY ACTUATED BRAKING SYSTEM

CROSS-REFERENCE TO RELATED APPLICATIONS

This application claims the benefit of U.S. Provisional Patent Application No. 61/555,812 filed on Nov. 4, 2011, which is hereby incorporated by reference in its entirety.

TECHNICAL FIELD

The present disclosure relates to a passively actuated braking system for moving a payload.

BACKGROUND

Overhead bridge cranes are widely used to lift and relocate large payloads. Generally, the displacement in a pick and place operation involves three translational degrees of freedom and a rotational degree of freedom along a vertical axis. This set of motions, referred to as a Selective Compliance Assembly Robot Arm ("SCARA") motions or "Schönflies" motions, is widely used in industry. A bridge crane allows motions along two horizontal axes. With appropriate joints, it is possible to add a vertical axis of translation and a vertical axis of rotation. A first motion along a horizontal axis is obtained by moving a bridge on fixed rails while the motion along the second horizontal axis is obtained by moving a trolley along the bridge, perpendicularly to the direction of the fixed rails. The translation along the vertical axis is obtained using a vertical sliding joint or by the use of a belt. The rotation along the vertical axis is obtained using a rotational pivot with a vertical axis.

SUMMARY

A movement system configured for moving a payload. The movement system includes a rail, a trolley, and a braking system. The trolley is movably attached to the rail and configured to support the payload. The braking system is operatively attached to the rail. The braking system includes a braking module including a base, operatively attached to the trolley, and a wheel assembly, operatively attached to the base. The wheel assembly has a shaft, a clutch, and a braking wheel. The shaft is rotatably attached to the base and is configured for rotation relative to the base about a rolling axis. The clutch is rigidly attached to the shaft and is configured for rotation with the shaft about the rolling axis. The braking wheel axially surrounds the clutch and is in continuous rolling contact with a surface of the rail. The clutch is configured to selectively allow rotation of the braking wheel relative to the shaft in only one direction of rotation to decelerate movement of the trolley along the rail.

In another aspect, a movement system is configured for moving a payload. The movement system includes a pair of rails, a bridge crane, a trolley, a handle, a first braking module, and a second braking module. The pair of rails extends in spaced and generally parallel relationship to one another. The bridge crane is operatively attached to the pair of rails and is movable along the pair of rails along an X axis. The trolley is operatively attached to the bridge crane and is movable along the bridge crane along a Y axis. The handle pivotally extends from the trolley. The cables operatively interconnect the handle and each of the first and second braking modules. The first braking module is operatively attached to the bridge crane and is configured to be selectively actuated by one of the cables in response to pivoting the handle relative to the trolley to decelerate movement of the bridge crane along the X axis. The second braking module is operatively attached to the trolley and is configured to be selectively actuated by another one of the cables in response to pivoting the handle relative to the decelerate movement of the trolley along the Y axis.

A braking module includes a base and a wheel assembly. The wheel assembly includes a braking wheel, a clutch, a shaft, and a disk brake. The shaft is rotatably attached to the base and is configured for rotation about a rolling axis. The braking wheel and the clutch are rigidly attached to the shaft and configured for rotation with the shaft about the rolling axis. The braking wheel axially surrounds the clutch and is configured for continuous rolling contact with a surface. The disk brake includes a braking disk and a brake. The braking disk is rigidly attached to the shaft and is configured for rotation with the shaft about the rolling axis. The brake is operatively attached to the base and is configured to apply braking action on the braking disk to stop rotation of the braking disk in response to a braking command. The clutch is configured such that when rotation of the shaft about the rolling axis is stopped in response to activation of the brake. The braking wheel is rotatable in a first direction and prevented from rotation relative to the rolling axis in a second direction, opposite the first direction. The clutch is configured such that when the brake is not activated, rotation of the shaft about the rolling axis is not stopped by the brake and the braking wheel is rotatable in the first direction and the second direction.

The above features and advantages and other features and advantages of the present teachings are readily apparent from the following detailed description of the best modes for carrying out the present teachings when taken in connection with the accompanying drawings.

DETAILED DESCRIPTION

Figure 1:
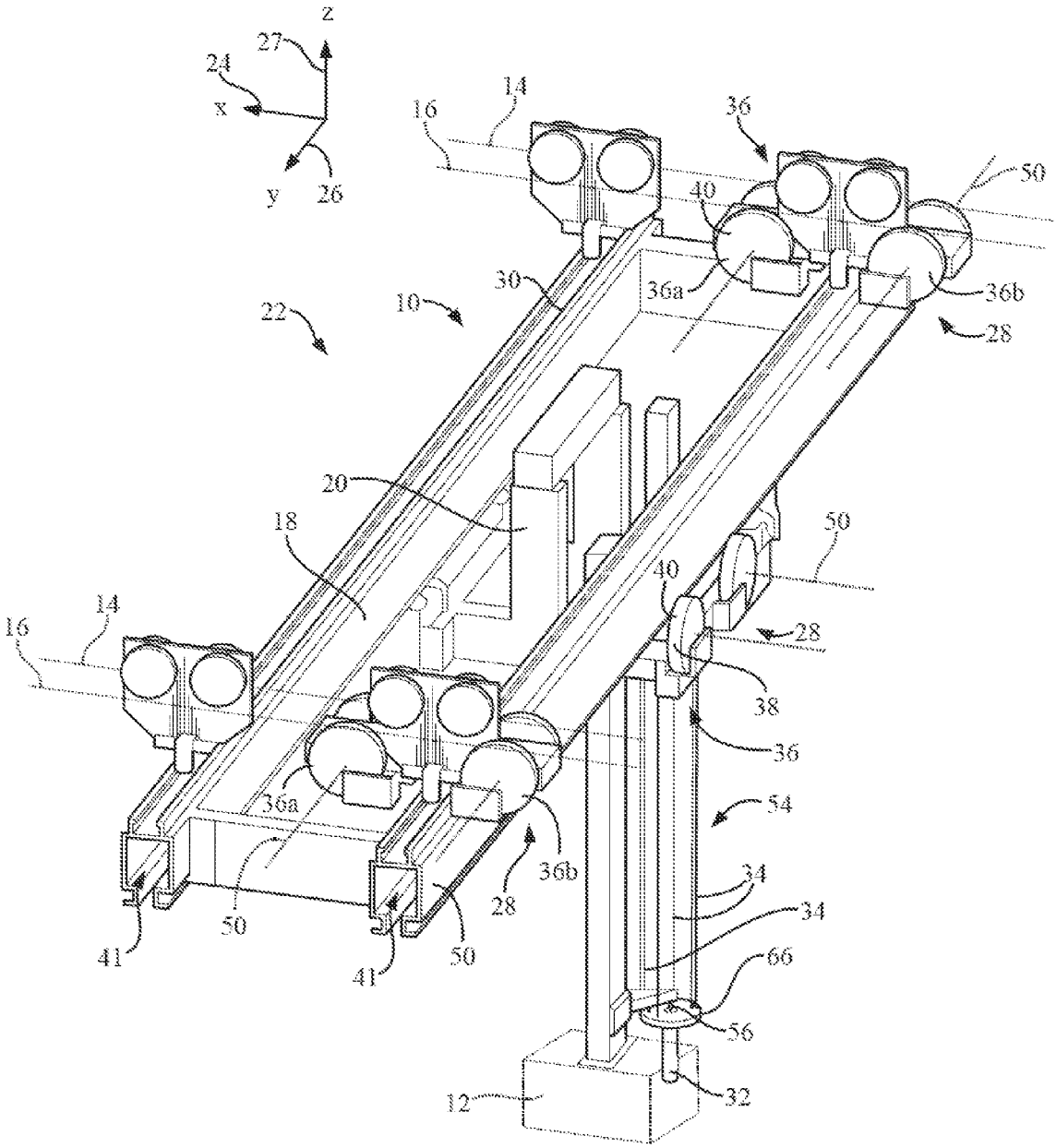
FIG. 1 is a schematic perspective view of a movement system including a braking system including a plurality of braking modules movably supported by a support structure.

Referring to the drawings, wherein like reference numbers refer to like components, a movement system 10 configured for moving a payload 12 in a plurality of directions is shown at 10 in FIG. 1. The movement system 10 is mounted to a stationary support structure 14 that is configured to support the movement system 10 and the payload 12. The support structure 14 includes, but is not limited to a pair of parallel rails 16 or runway tracks.

Figure 2:
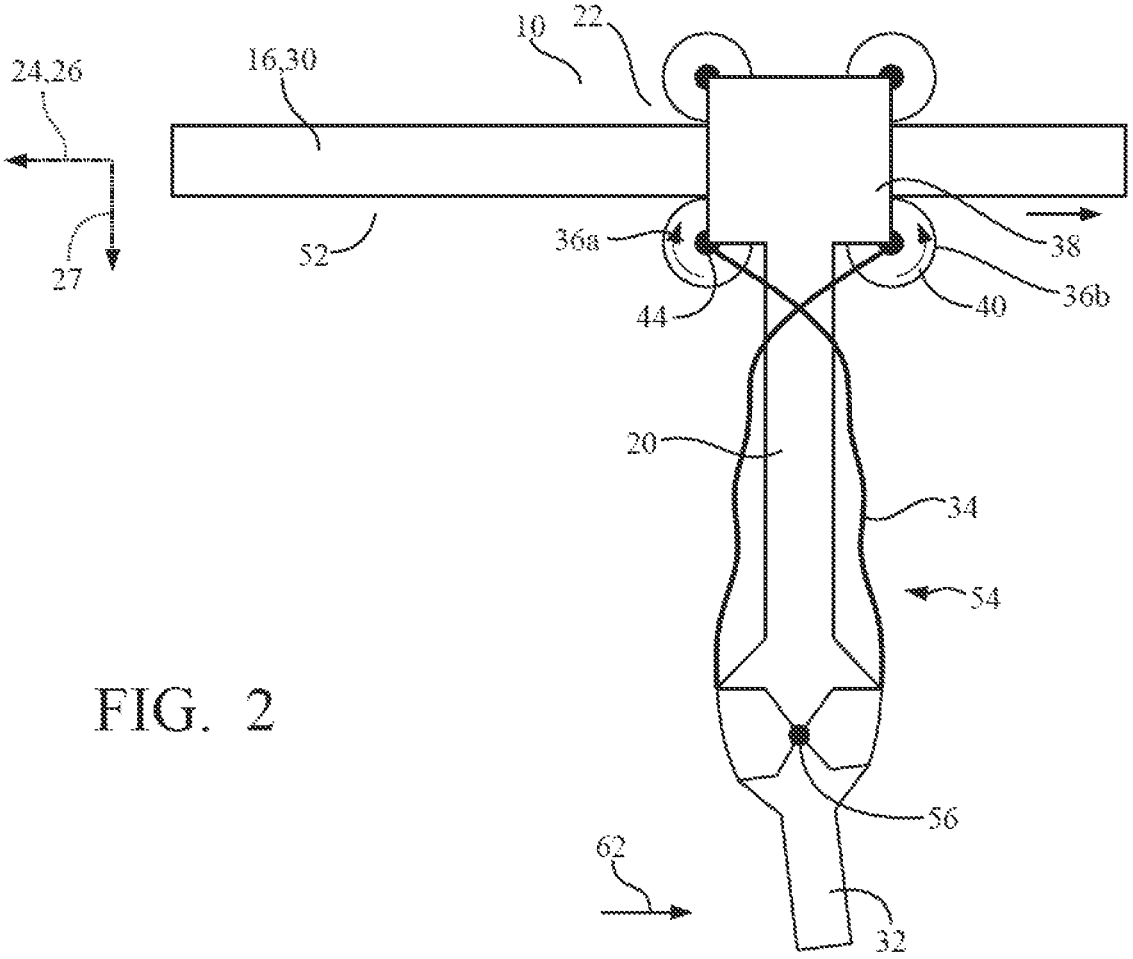
FIG. 2 is a schematic side view of the movement system.

Referring to FIGS. 1 and 2, the movement system 10 includes a bridge crane 18, a trolley 20, and a braking system 22. The bridge crane 18 is a structure that includes a pair of girders 30 that span the pair of parallel rails 16. The bridge crane 18 is adapted to carry the payload 12 along an X axis 24. The trolley 20 is movably attached to girders 30 of the bridge crane 18 such that the trolley 20 is adapted to carry the payload 12 along a Y axis 26, in generally perpendicular relationship to the X axis 24. A loader may be supported by the frame and is configured for attachment to a load, such as the trolley 20, an end effector, the payload 12, and the like.

As will be described in more detail below, the braking system 22 is operatively attached to at least one of the bridge crane 18 and the trolley 20. Payloads 12 that are manually handled using the movement system 10 can be very heavy. The deceleration of the payload 12 is especially critical. Indeed, it may be difficult to rapidly stop a heavy payload 12 in case of a potential collision with the environment. The braking system 22 may be configured to assist with the deceleration of the payload 12. Additionally, the braking system 22 may reduce the effort made by an operator in order to decelerate the payload 12. The braking system 22 includes braking modules 28, a handle 32, and cables 34. The modules 28 may be operatively attached to the bridge crane 18 and/or the trolley 20 to selectively stop movement of the bridge crane 18 and/or the trolley 20 along the respective X axis 24 and Y axis 26.

Figure 3:
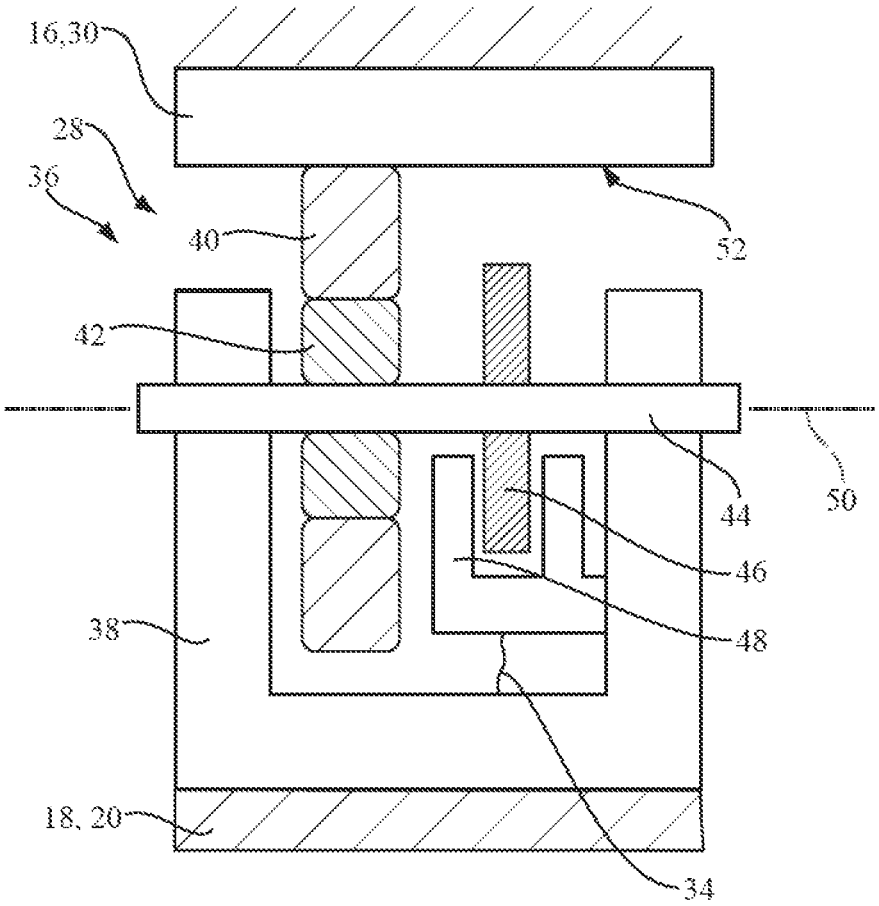
FIG. 3 is a schematic partial cross sectional view of the braking module of the braking system.

Referring to FIGS. 2 and 3, the modules 28 include at least one wheel assembly 36 and a base 38. Each wheel assembly 36 includes a braking wheel 40, a clutch 42, a shaft 44, a braking disk 46, and a brake 48. The base 38 is operatively attached to the bridge crane 18 or the trolley 20. The shaft 44 is rotatably attached to the base 38 and configured for rotation about a rolling axis 50. The braking wheel 40 and the clutch 42 are rigidly attached to the shaft 44 and configured for rotation with the shaft 44 about the rolling axis 50. The braking wheel 40 axially surrounds the clutch 42. The braking wheel 40 is in continuous rolling contact with a surface 52 of the respective rail 16 or girder 30. The clutch 42 is configured to allow rotation between the braking wheel 40 and the shaft 44 in only one direction. The brake 48 may be a rotational brake 48, such as a disk brake 48, which is configured to apply braking action to the respective braking wheel 40, via the clutch 42. The rotation of the braking disk 46 is stopped if the brake 48 is activated via a braking command. The brake 48 is activated through the braking command of pulling on, or otherwise tensioning, the respective cable 34.

Tensioning of the cable 34 activates the respective brake 48, which, in turn, engages the braking disk 46, ceasing rotation of the shaft 44 about the rolling axis 50. When rotation of the shaft 44 about the rolling axis 50 is ceased, the braking wheel 40 is still allowed to rotate, relative to the clutch 42, about the rolling axis 50 in a first direction, while being blocked from rotating in a second direction, opposite the first direction. Conversely, when the brake 48 is not activated, the braking wheel 40 rotates with the shaft 44 about the rolling axis 50 in the second direction, while still being able to rotate about the rolling axis 50 in the first direction. Therefore, the clutch 42 is configured to allow free motion of the braking wheel 40 in the first direction, and decelerates or otherwise prevents motion in the second direction, upon application of the brake 48, resulting from the application of a force 62 to the respective cable 34.

Figure 5:
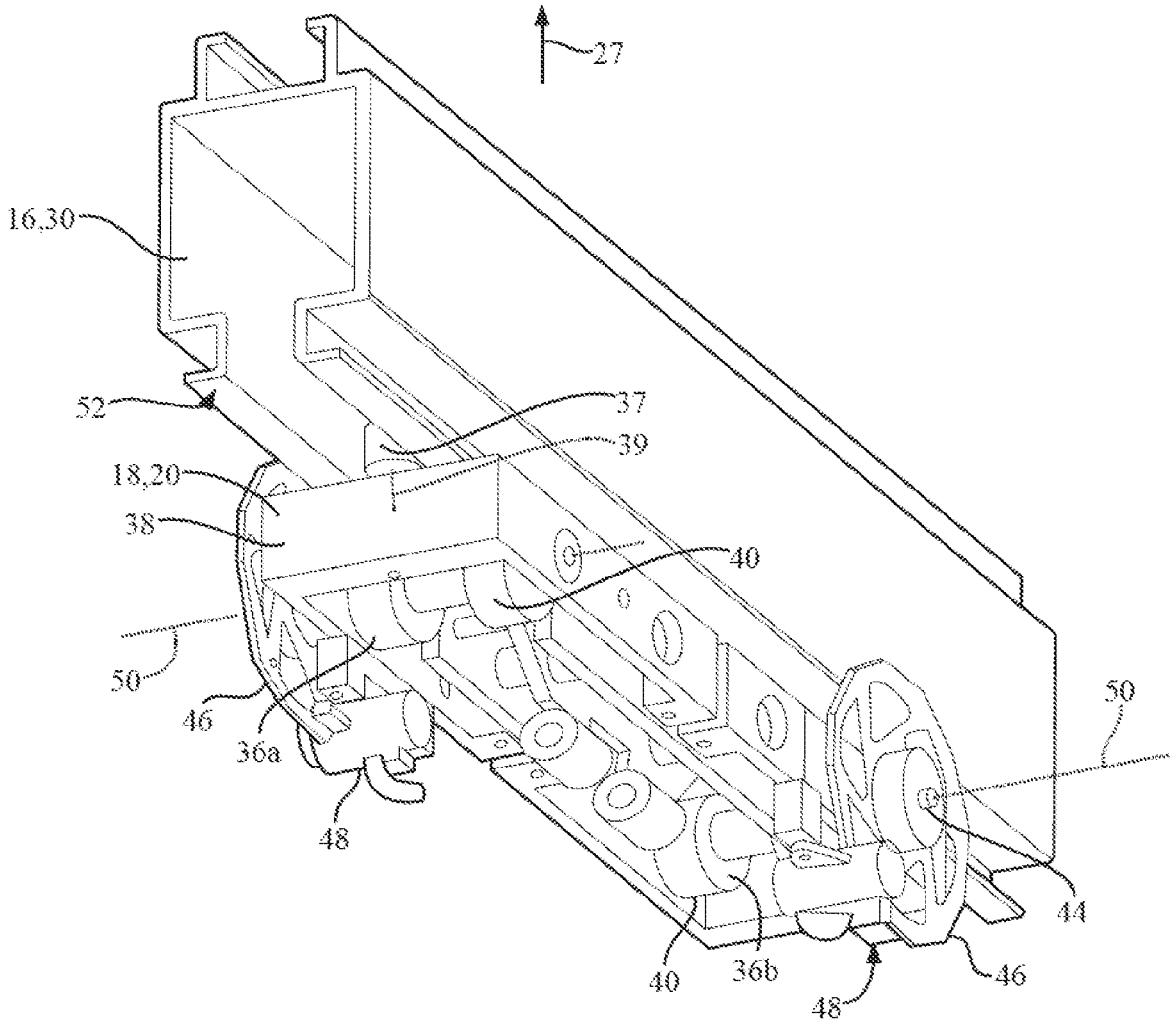
FIG. 5 is a schematic perspective view of a braking module of FIG. 1.

Each module 28 may include two wheel assemblies 36, i.e., a first wheel assembly **36*a* and a second wheel assembly 36*b*, as shown in FIGS. 1, 2, and 5, which are operatively disposed on the base 38 in spaced relationship to one another. Each wheel assembly 36 may be configured such that each clutch 42 allows rotation about the respective rolling axis 50 in opposite directions from one another. More specifically, the rotation of the braking wheel 40 of the first wheel assembly 36*a* in the first direction may be clockwise, whereas the rotation of the braking wheel 40 of the second wheel assembly 36*b* in the first direction may be counterclockwise. Additionally, the brake 48 of each wheel assembly 36 would be operatively connected to a respective cable 34, which provides independent activation of the two wheel assemblies 36**.

The braking system 22 allows braking actions along the X axis 24 (bridge crane 18) and/or the Y axis 26 (trolley 20) to slow or stop movement of the trolley 20 and/or girder 30 in a respective direction of movement. The braking action is applied by the braking modules 28. The cables 34 may be slidably disposed in flexible tubes. More specifically, an operator may apply a force 62 to the handle 32 in a desired direction, opposite a direction of movement of the trolley 20 or bridge crane 18, to decelerate or stop the movement. The braking action along the X axis 24 stops or decelerates the bridge, along with components the bridge crane 18 supports. In order to obtain a symmetrical braking action of a long bridge crane 18, two braking modules 28 may be included, one at each rail 16. The braking modules 28 may be activated simultaneously from the handle 32 with the help of a cable system 54, as shown in FIG. 1. Similarly, the braking action along the Y axis 26 stops or decelerates the trolley 20 and the components supported by the trolley 20. If the trolley 20 is not very large, only one braking module 28 may be needed. However, if the trolley 20 is long, or symmetrical braking action is desired, two braking modules 28 may be included, one at each girder 30. The braking module 28 is activated from the braking handle 32 via the cable system 54. The cable system 54 includes a plurality of the cables 34.

Figure 4:
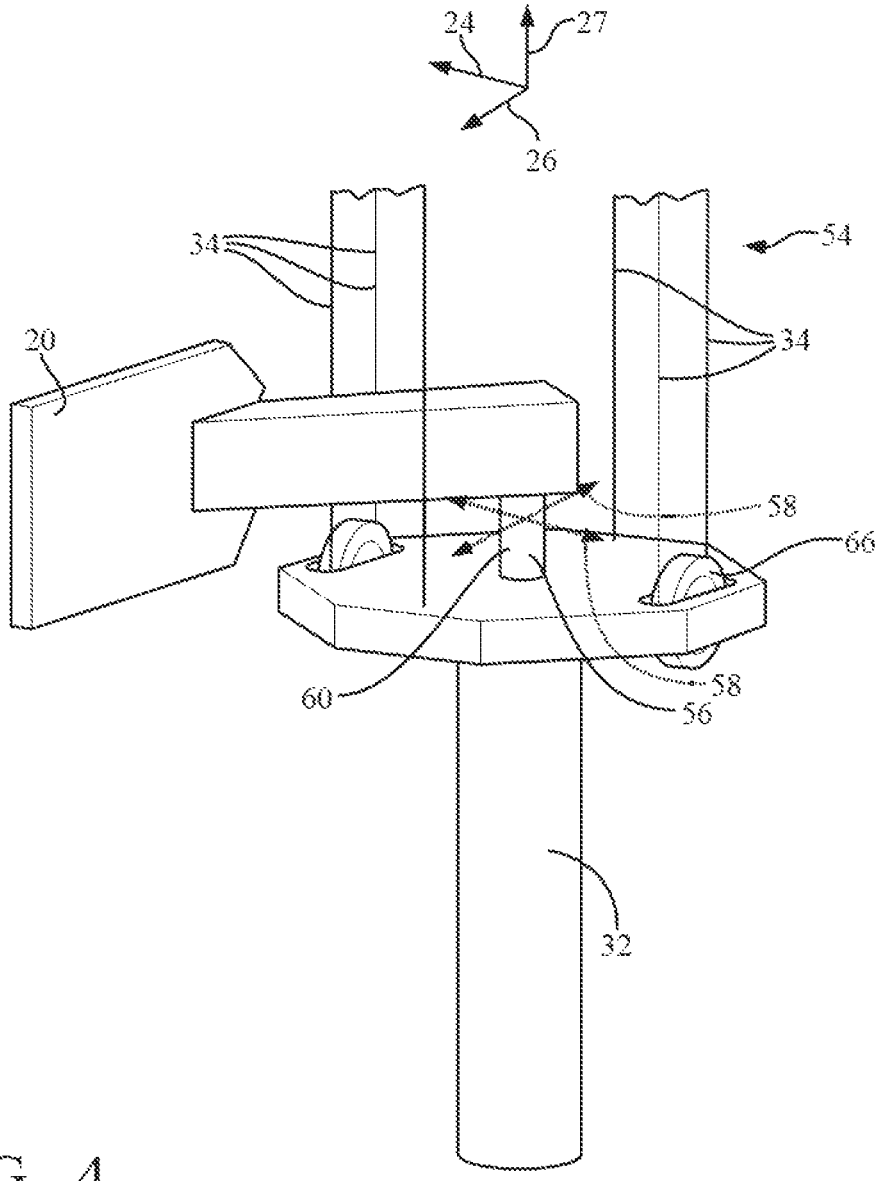
FIG. 4 is a schematic perspective view of a handle assembly and cable assembly of the braking system of FIG. 1.

Referring to FIGS. 1, 2, and 4, the handle 32 may be pivotably attached to the trolley 20 at a rotational joint 56. The rotational joint 56 may allow for movement, relative to the trolley 20, about a single axis or two axes 58, which may be perpendicular to one another. Further, each of the axes 58 may extend in parallel relationship to a corresponding X axis 24 and Y axis 26. The rotational joint 56 may also be a, Hooke joint 60, a ball-and-socket joint, and the like. The cables 34 operatively interconnect the handle 32 and the brake 48 of the respective wheel assembly 36. The brake 48 is activated if the respective cable 34 of the respective module 28 is tensioned by articulating the handle 32 about the rotational joint 56 about the axis corresponding to the X axis 24 or the Y axis 26.

The handle 32, illustrated in FIGS. 1, 2, and 4, allows the application of the force 62, i.e., "braking action", along the X axis 24 and/or Y axis 26. The handle 32 is supported by the Hooke joint 60, which allows two independent rotations along the perpendicular axes 58. When the handle 32 is pushed in a given direction, i.e., corresponding to the X axis 24 or Y axis 26, cables 34 which are attached to the handle 32 are selectively pulled (tensioned), which activates at least one corresponding brake 48 of the corresponding module 28. The Hooke joint 60 is configured such that it is possible to push the handle 32 in any direction in an X-Y plane, as defined by an intersection of the X axis 24 and the Y axis 26. Therefore, the total braking action can be any combination of braking along the X axis 24 and Y axis 26. For the braking action along the X axis 24, the cable 34 may be operatively connected to, or otherwise routed around, a pulley 66, as shown in FIGS. 1 and 4. This cable 34 routing has two objectives. The first objective is that since the handle 32 moves relative to the braking modules 28 that control motion along the X axis 24, the routing of the cables 34 around the pulley 66 makes the braking action in the X axis 24 direction independent from the position along Y axis 26 of movement. The second objective is that since two brakes 48 may be applied by the handle 32 simultaneously, the pulley 66 is configured to provide a distribution of the force 62 from the handle 32 to each of the two brakes 48. In order to avoid movement of the handle 32 along a Z axis 27, i.e., a vertical direction, relative to the ground, the handle 32 is fixed to the trolley 20. For the braking along the Y axis 26, the cable 34 may be directly attached to the handle 32, since there is only one Y axis 26 braking module 28 and since this braking module 28 travels along with the handle 32 (both are fixed to the trolley 20).

Figure 6:
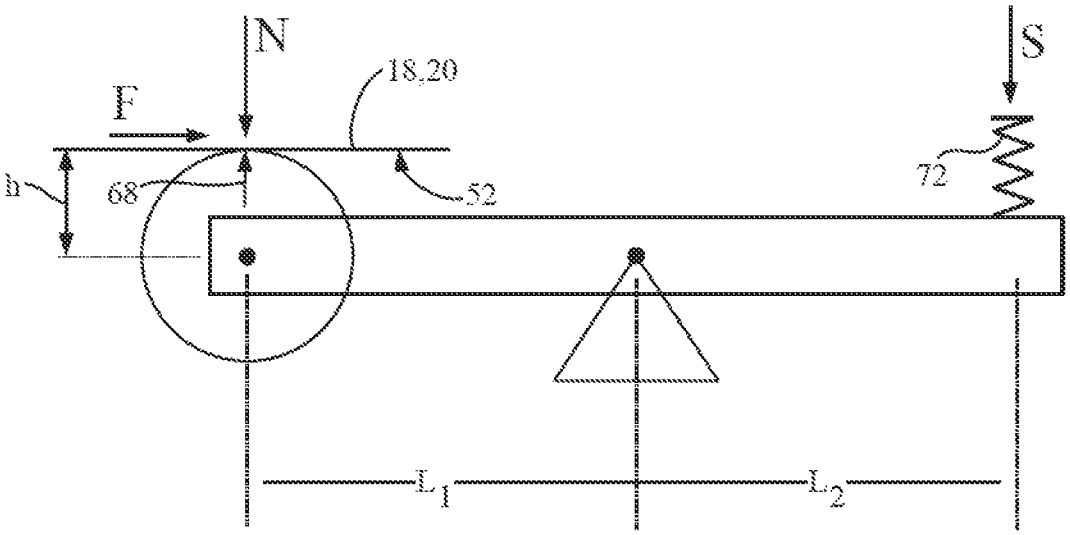
FIG. 6 is a schematic side diametric view of a force diagram of the braking module of FIG. 5.

Referring to FIG. 1, the braking system 22 is configured for movement along the X axis 24 and/or the Y axis 26. The braking system 22 includes the base 38 and two braking modules 28. The shafts 44 for each braking module 28 are operatively attached to the base 38 and are configured to rotate around the respective rolling axis 50. Each braking module 28 includes a pair of braking wheels 40 on a single shaft 44 in spaced relationship to one another such that the pair of brake 48 wheels rotated about the same rolling axis 50. Referring to FIG. 6, pressure 68 is applied by the braking wheels 40 on the surface 52 of the rail 16 or girder 30 as a function of a screw and a compression spring 72. The screw allows adjustment of the pressure 68 on the surface 52 of the rail 16 or girder 30. Also, the compression spring 72 facilitates the adjustment of the pressure 68 and allows uniform pressure 68 on the surface 52 of the rail 16 or girder 30 to be maintained as the braking wheels 40 roll along the surface 52 of the rail 16 or girder 30. Finally, the base 38 is configured to allow the pressure 68 between the braking wheels 40 and the surface 52 of the rail 16 or girder 30 to increase as braking occurs. Therefore, a small free-running pressure 68 between the braking wheels 40 and the surface 52 of the rail 16 or girder 30 is maintained, along with a desired braking pressure 68. Indeed, a tangential force induces an additional normal force because of the geometry of the system. Referring again to FIG. 6, F is the tangential force, N is the normal force and S is the force applied by the compression spring 72. Also, $\mu$ is the coefficient of friction. The maximum tangential force without sliding between the braking wheel 40 and the surface 52 of the rail 16 or girder 30 can be computed as:

$$F = \frac{Sl_2}{\frac{l_1}{\mu} - h}.$$

It is of interest to increase the available braking force with this geometry, but the maximum force should not exceed the force that can be resisted by the rolling axis 50. For illustration, let $l_1=l_2=\mu=1$. Then, $$F = \frac{S}{1-h}. \tag{3.2}$$

It is desired for h to be between 0 and 1. For instance, it is suggested that h=0.5. As a result, F=2S.

If the braking modules 28 are not properly aligned with the surfaces 52 of the rail 16 or girder 30, the braking system 22 may also include vertical rollers 37, as shown in FIG. 5. The vertical rollers 37 may extend from the base 38 and rotate about an alignment axis 39. The alignment axis 39 may be generally perpendicular to the rolling axis 50. The vertical rollers 37 may be configured to extend within a channel 41 defined between the surfaces 52 of the rail 16 or girder 30.

Figure 9:
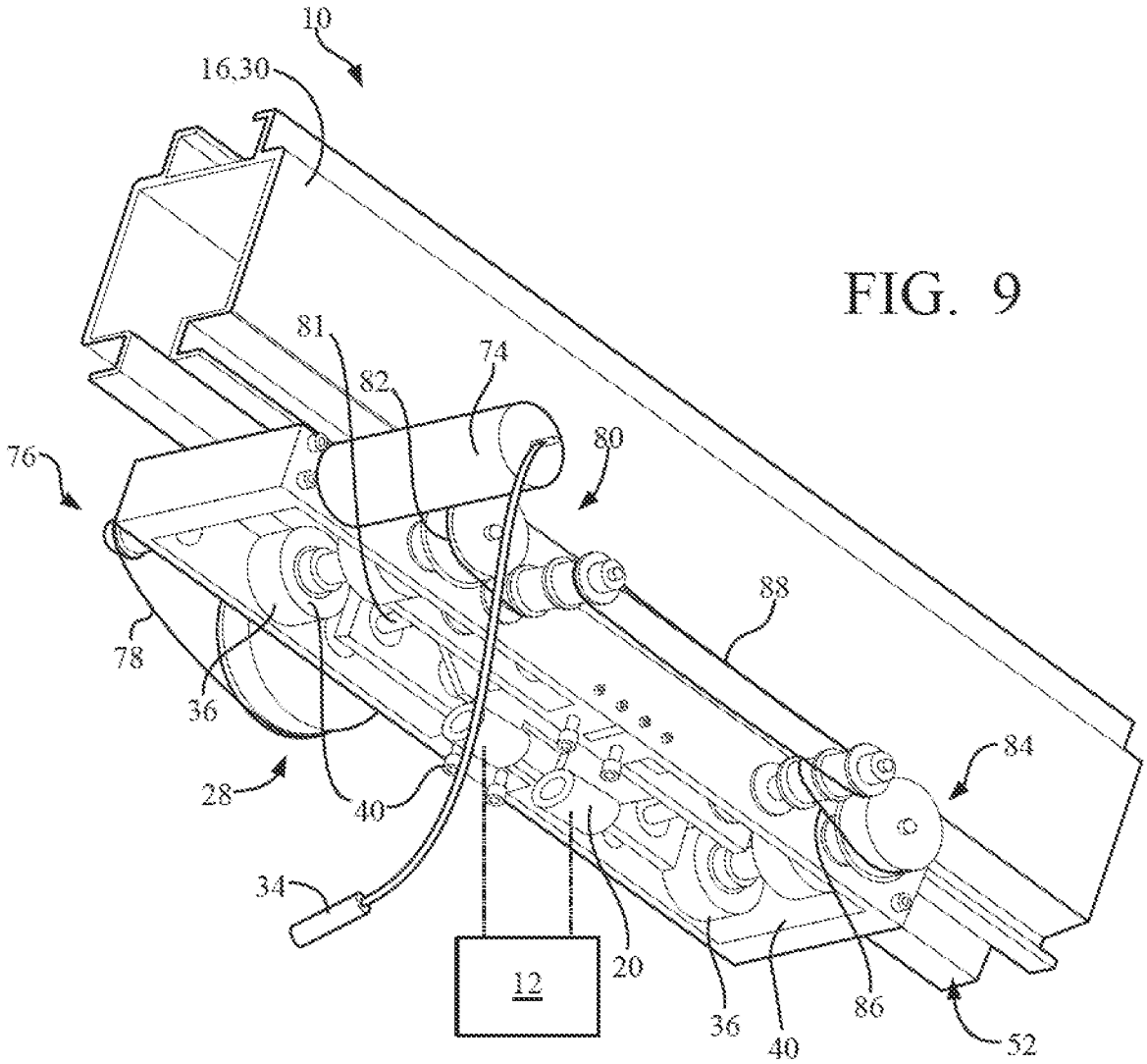
FIG. 9 is a schematic perspective view of another braking module of FIG. 1.
Figure 10:
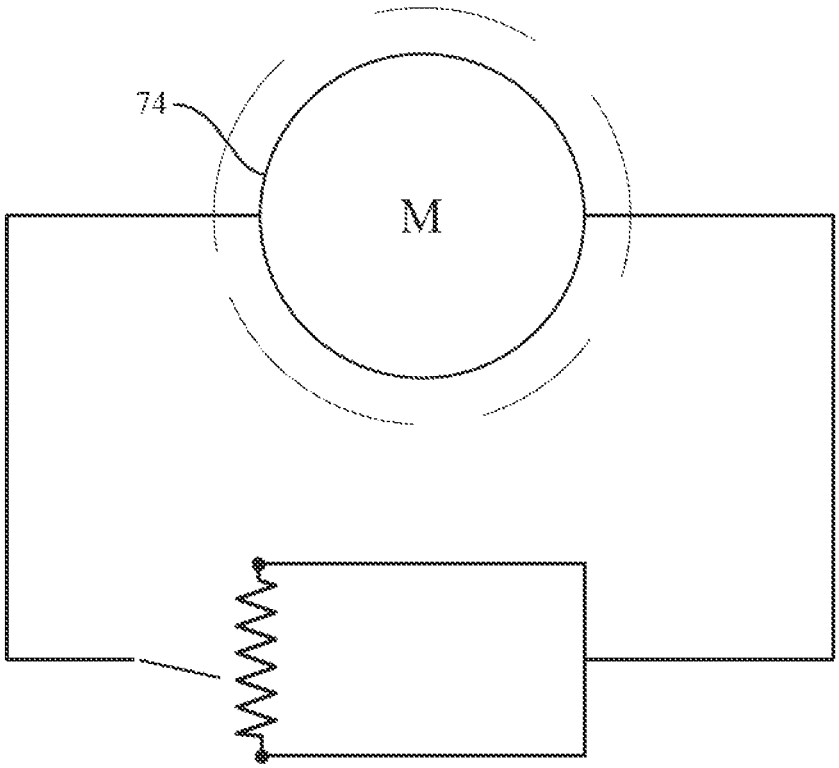
FIG. 10 is a schematic diagrammatic view of an electrical circuit of the braking module of FIG. 9.

Referring to FIG. 9, it should be appreciated that electric cables 34 may also be used instead of mechanical cables 34. Depending on the force applied on the braking handle 32, the voltage/current in the electric cables 34 would be modified. The stiffness of the handle 32 may be adjusted in order to obtain a displacement proportional to an applied force at the handle 32. Potentiometers may be used to modify the voltage/current accordingly to the displacement of the handle 32. More specifically, the cables 34 may be operatively connected to a motor 74 of the braking module 28. The motor 74 may be rotatably connected to a first set of pulleys 76 and one of the wheel assemblies 36. Therefore, as the wheels 40 of the wheel assembly 36 rotate along the surface 52 of the respective rail 16 or girder 30, the first set of pulleys 76 rotate and the rotation of the wheels 40 also rotate the motor 74. The first set of pulleys 76 are rotatably connected to one another via a first belt 78. One of the pulleys of the first set of pulleys 76 is rotatably connected to one of the pulleys of a second set of pulleys 80, via a driveshaft 81. The second set of pulleys 80 are rotatably connected to one another via a second belt 82. A third set of pulleys 84 are rotatably connected to one another via a third belt 86. One of the third set of pulleys 84 is rotatably connected to another of the wheel assemblies 36. A fourth belt 88 rotatably connects one of the second set of pulleys 80 and one of the third set of pulleys 84 and acts as a timing belt to transfer braking force from one of the braking modules 28 to the other braking module 28. Accordingly, rotation of the wheel assemblies 36 rotates the motor 74. Since the required braking action is proportional to the effort applied on the handle 32, the required electronics would not require control hardware.

The transmission through electric cables 34 is more flexible and is not altered by mechanical efficiency. Depending on the force applied on the braking handle 32, the voltage/current in the electric cables 34 would be modified. The stiffness of the handle 32 can be adjusted in order to obtain a displacement proportional to an applied force. Then, potentiometers can be used to modify the voltage/current accordingly to their displacement. The back electromotive force (emf) voltage of an electric motor 74 can be used to brake the trolley 20. The handle 32 in combination with the cables 34 may be used to control the amount of back-emf current passing through the motor 74 and subsequently control the braking force of the braking module 28. In one embodiment, an electric diode may be used. Depending on the direction of the back-emf current, the electric diode will or will not let the current pass through, which determines if the braking system 22 will apply the braking force. In another embodiment, an encoder and a dual D type flip flop chip may be used to determine the direction of the passive system. Once the direction of the current is known, the direction is compared with a signal from a force sensor to determine how much the system should brake.

Figure 7:
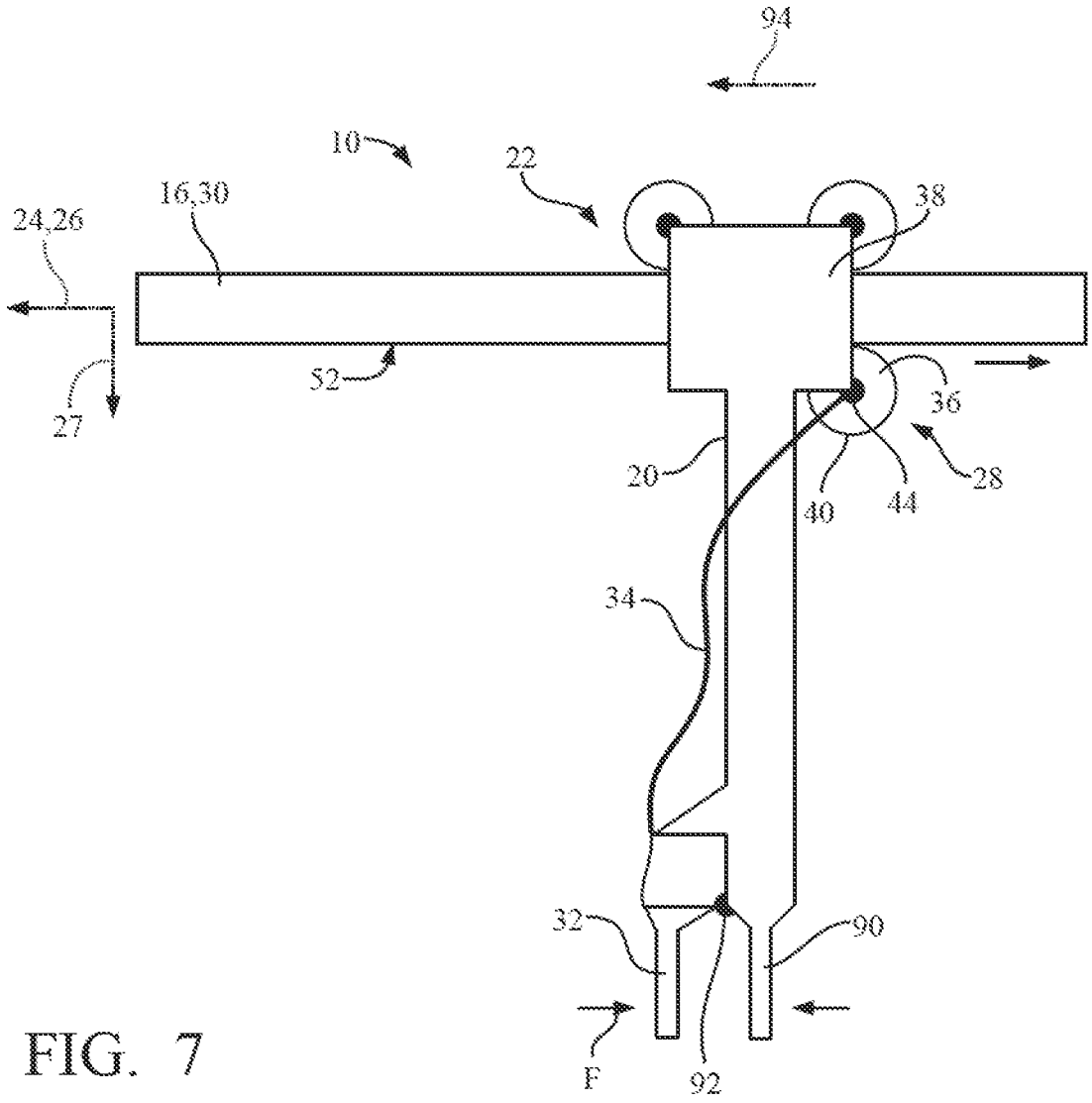
FIG. 7 is a schematic side view of another embodiment of the braking system.

Referring now to FIG. 7, the braking system 22 includes a braking module 28 that includes at least one wheel assembly 36 and the base 38 which supports the wheel assembly 36. The wheel assembly 36 includes the braking wheel 40, which is in continuous rolling contact with the surface 52 of the respective rail 16 or girder 30. The trolley 20 extends to a grip 90 configured for being grasped by the operator. A handle 32, is pivotally attached to the grip 90 at a pivot 92. The cable 34 operatively extends between the handle 32 and the module 28. The trolley 20 is moved in a direction of motion 94 along the respective rail 16, or girder 30 by pushing or pulling on the grip 90, or any other portion of the trolley 20. In this embodiment, the braking module 28 does not include a clutch. The operator stops or decelerates the motion 94 of the trolley 20 by applying force F to the handle 32 such that the handle 32 pivots about the pivot 92, toward the grip 90. Pivoting the handle 32 toward the grip 90, pulls on the cable 34, causing the cable 34 to act on the wheel assembly 36 and stop or decelerate the rotation of the wheel assembly 36. Therefore, this allows the operator to intentionally apply or operate the braking system 22. It should be appreciated that if it is desired to brake the braking system 22 in both the X direction and Y direction simultaneously, braking modules 28 may be attached to each of the X axis 24 and Y axis 26, and the cables 34 attached to a single handle 32. However, if it is desired to apply the braking system 22 in the X direction, independent of the Y direction, then two handles 32 may be attached to braking modules 28 that are each dedicated to the respective X axis 24 and Y axis 26, or a single handle 32 having two degrees-of-freedom.

Figure 8:
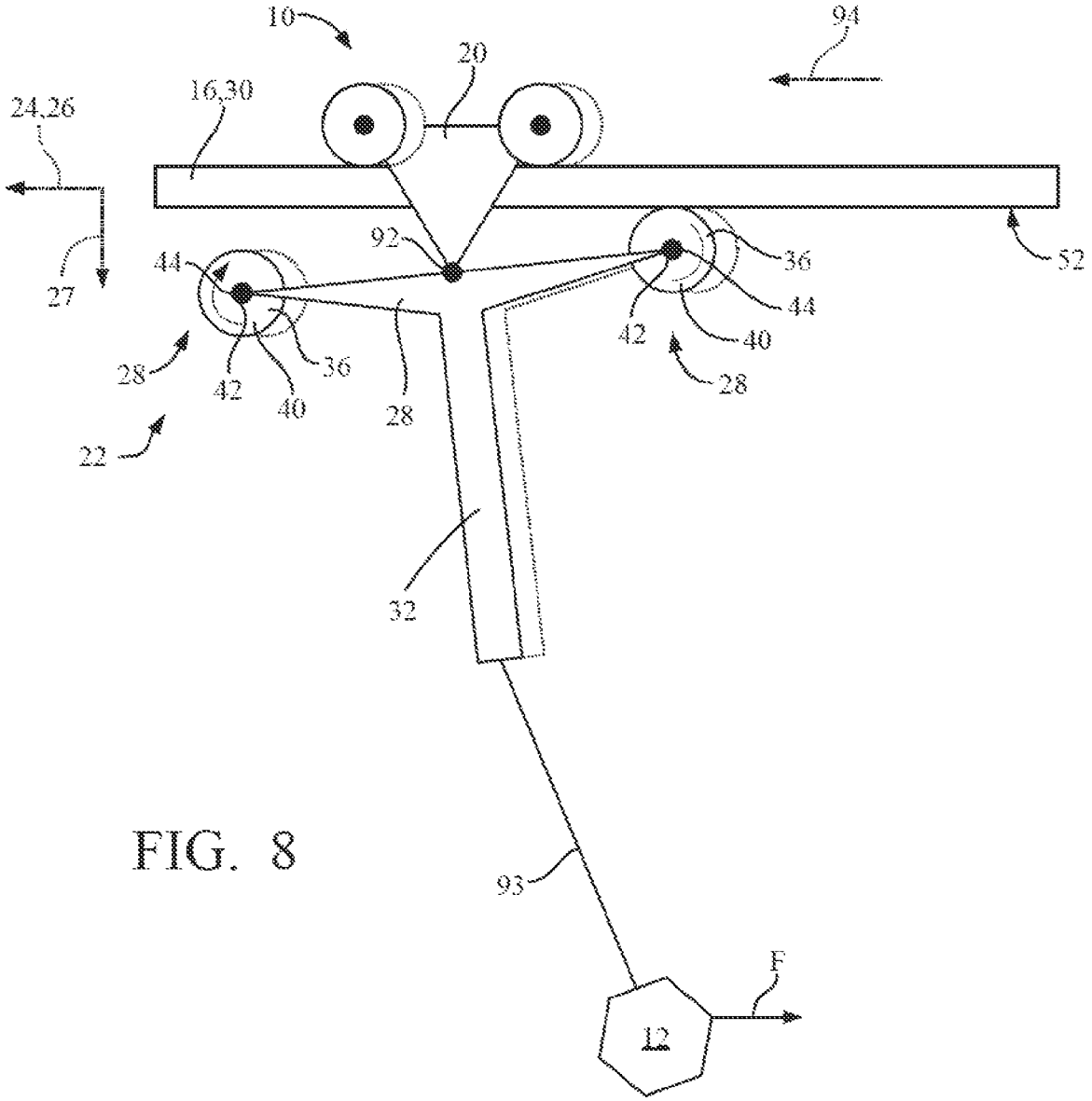
FIG. 8 is a schematic side view of another embodiment of the braking system.

In another braking system 22, shown in FIG. 8, the braking module 28 and handle 32 are fixed together and pivotally attached to the trolley 20 at a braking pivot 92. A wheel assembly 36 is disposed at opposing ends of the braking module 28, such that the braking pivot 92 is disposed between wheel assemblies 36. The wheel assemblies 36 include the braking wheel 40 which radially surrounds a one-way clutch 42. The one-way clutch is rigidly attached to a shaft 44, which is rigidly attached to the braking module 28. Pushing on the handle causes the braking module 28 to pivot about the braking pivot 92 in the direction of the pushing. The braking module 28 pivots about the braking pivot 92 until the wheel assembly 36 opposite the direction of pushing contacts the surface 52 of the respective rail 16 or girder 30. The wheel 40 associated with the wheel assembly 36 which is in contact with the surface 52 of the rail 16 or girder 30 rolls along the surface 52, along with the trolley 20, if the pushing is into the direction of motion 94. In order to decelerate the trolley 20, the operator pushes or pulls the handle 32, opposite the direction of motion 94.

While the payload 12 was rigidly attached to the trolley 20 in the preceding embodiments, the payload 12 can also be suspended, through a suspension cable 93, to a handle 32. This is illustrated in FIG. 8. In order to move the payload 12 along the respective rail 16 or girder 30, the operator pushes directly on the payload 12. The trolley 20 (and bridge crane 18) are indirectly pushed and moved together via the pull on the suspension cable 93. Pushing on the payload 12 also causes the handle 32 to pivot about the braking pivot 92 in the direction of pushing, similarly to what happens when the handle 32 is pushed directly by the operator. Therefore, pushing on the payload 12 opposite to the direction of motion indirectly activates the braking system in order to assist with the deceleration of the trolley 20 and the payload 12. While the payload 12 and suspension cable 93 are illustrated in the context of the braking system of FIG. 8, the payload 12 and suspension cable 93 can also be attached to the handle 28 of the preferred braking system illustrated in FIG. 2.

While the best modes for carrying out the disclosure have been described in detail, those familiar with the art to which this disclosure relates will recognize various alternative designs and embodiments for practicing the disclosure within the scope of the appended claims.

The invention claimed is:

1. A movement system configured for moving a payload, the movement system comprising:

a rail;

a trolley movably attached to the rail and configured to support the payload;

a braking system operatively attached to the rail;

wherein the braking system includes a braking module including a base, operatively attached to the trolley, and a wheel assembly operatively attached to the base;

wherein the wheel assembly has a shaft, a clutch and a braking wheel;

wherein the shaft is rotatably attached to the base and configured for rotation relative to the base about a rolling axis;

wherein the clutch is rigidly attached to the shaft and configured for rotation with the shaft about the rolling axis;

wherein the braking wheel axially surrounds the clutch and is in continuous rolling contact with a surface of the rail; and wherein the clutch is configured to selectively allow rotation of the braking wheel relative to the shaft in only one direction of rotation to decelerate movement of the trolley along the rail.

2. A movement system, as set forth in claim 1, the wheel assembly further including a disk brake configured to selectively apply braking action to the braking wheel.

3. A movement system, as set forth in claim 2, wherein the disk brake includes:

a braking disk rigidly attached to the shaft and configured for rotation with the shaft about the rolling axis; and a brake operatively attached to the base and configured to apply braking action on the braking disk to stop rotation of the braking disk in response to a braking command.

4. A movement system, as set forth in claim 3, wherein the clutch is configured such that when rotation of the shaft about the rolling axis is stopped in response to activation of the brake, the braking wheel is rotatable in a first direction and prevented from rotation relative to the rolling axis in a second direction, opposite the first direction; and wherein the clutch is configured such that when the brake is not activated, rotation of the shaft about the rolling axis is not stopped by the brake and the braking wheel is rotatable in the first direction and the second direction.

5. A movement system, as set forth in claim 4, wherein the wheel assembly is further defined as a first wheel assembly and a second wheel assembly; and wherein the first and second wheel assemblies are operatively attached to the base in spaced relationship to one another and arranged such that the first direction of rotation of the braking wheel of the first wheel assembly is opposite the first direction of rotation of the braking wheel of the second wheel assembly.

6. A movement system, as set forth in claim 5, further comprising a handle pivotally extending from the trolley;

wherein the braking system further includes a cable operatively connected to the brake;

wherein the braking command is further defined as tensioning the cable such that the brake is activated to stop rotation of the braking disk;

wherein the cable of the first wheel assembly is operatively attached between the handle and the first wheel assembly and the cable of the second wheel assembly is operatively attached between the handle and the second wheel assembly; and wherein the handle is configured to pivot, relative to the trolley, opposite a direction of movement of the trolley to tension the cable corresponding the wheel assembly opposite the direction of movement of the trolley such that the disk brake is activated.

7. A movement system, as set forth in claim 6, wherein the handle is pivotally attached to the trolley at a pivotal joint.

8. A movement system, as set forth in claim 5, further comprising a first set of pulleys, a second set of pulleys, and a third set of pulleys;

wherein the first set of pulleys are rotatably connected to one another via a first belt;

wherein a driveshaft rotatably connects one of the pulleys of the first set of pulleys to one of the pulleys of the second set of pulleys;

wherein the second set of pulleys are rotatably connected to one another via a second belt;

wherein the third set of pulleys are rotatably connected to one another via a third belt;

wherein of the pulleys of the second set of pulleys is connected to one of the pulleys of the third set of pulleys via a fourth belt; and wherein the fourth belt is configured to operate as a timing belt to transfer a braking force from one of the first and second braking modules to the other of the first and second braking modules.

9. A movement system, as set forth in claim 8, further comprising:

a motor operatively connected to the trolley;

a handle operatively connected to the trolley;

a cable operatively interconnecting the motor and the handle;

wherein the handle is configured to receive an input from an operator to decelerate movement of the trolley along the rail;

wherein cable is configured to transmit the input to the motor such that the motor decelerates movement of the trolley along the rail.

10. A movement system configured for moving a payload, the movement system comprising:

a pair of rails extending in spaced and generally parallel relationship to one another;

a bridge crane operatively attached to the pair of rails and movable along the pair of rails along an X axis;

a trolley operatively attached to the bridge crane and movable along the bridge crane along a Y axis;

a handle pivotally extending from the trolley;

a first braking module and a second braking module;

a plurality of cables operatively interconnecting the handle and each of the first braking module and the second braking module;

wherein the first braking module is operatively attached to the bridge crane and configured to be selectively actuated by one of the cables in response to pivoting the handle relative to the trolley to decelerate movement of the bridge crane along the X axis; and wherein the second braking module is operatively attached to the trolley and configured to be selectively actuated by another one of the cables in response to pivoting the handle relative to the decelerate movement of the trolley along the Y axis;

wherein each of the first and second braking modules includes a base, operatively attached to a respective one of the bridge crane and the trolley, and a wheel assembly, operatively attached to the base;

wherein each of the first and second wheel assemblies includes a shaft, a clutch, and a braking wheel;

wherein the shaft is operatively attached to the base;

wherein the clutch is rigidly attached to the shaft and configured for rotation with the shaft about the rolling axis;

wherein the braking wheel axially surrounds the clutch; and wherein the clutch is configured to selectively allow rotation of the braking wheel relative to the shaft in only one direction of rotation to decelerate the payload.

11. A movement system, as set forth in claim 10, wherein the base of the first braking module is operatively attached to the bridge crane such that the braking wheel of the first braking module is in continuous rolling contact with a surface of one of the pair of rails; and wherein the base of the second braking module is operatively attached to the trolley such that the braking wheel of the second braking module is in continuous rolling contact with a surface of the bridge crane.

12. A movement system, as set forth in claim 11, wherein the wheel assemblies each include a disk brake configured to apply braking action to the respective braking wheel.

13. A movement system, as set forth in claim 12 wherein the disk brake includes:

a braking disk rigidly attached to the shaft and configured for rotation with the shaft about the rolling axis; and a brake operatively attached to the base and configured to apply braking action on the braking disk to stop rotation of the braking disk in response to a braking command.

14. A movement system, as set forth in claim 13, the braking system further including a cable operatively connected to the brake;

wherein the braking command is further defined as tensioning the cable such that the brake is activated to stop rotation of the braking disk.

15. A movement system, as set forth in claim 14, wherein the clutch is configured such that when rotation of the shaft about the rolling axis is stopped in response to activation of the brake, the braking wheel is rotatable in a first direction and prevented from rotation relative to the rolling axis in a second direction, opposite the first direction; and wherein the clutch is configured such that when the brake is not activated, rotation of the shaft about the rolling axis is not stopped by the brake and the braking wheel is rotatable in the first direction and the second direction.

16. A movement system, as set forth in claim 15, wherein each wheel assembly is further defined as a first wheel assembly and a second wheel assembly; and wherein the first and second wheel assemblies are operatively attached to the base in spaced relationship to one another and arranged such that the first direction of rotation of the braking wheel of the first wheel assembly is opposite the first direction of rotation of the braking wheel of the second wheel assembly.

17. A movement system, as set forth in claim 16, wherein the cable of the first wheel assembly operatively interconnects the handle and the first wheel assembly and the cable of the second wheel assembly operatively interconnects the handle and the second wheel assembly; and wherein the handle is configured to pivot, relative to the trolley, opposite a direction of movement of the trolley to tension the cable corresponding to at least one of the first and second wheel assemblies opposite the direction of movement of the trolley, such that the disk brake is activated.

* * * * *